US005881021A

United States Patent [19]

Pirie et al.

[11] Patent Number: 5,881,021

[45] Date of Patent: Mar. 9, 1999

[54] QUICK CHARGE CAPACITOR POWERED NON-INTERRUPTIBLE WEARABLE PERSONAL SECURITY ALARM

[75] Inventors: Wendy D. Pirie, West Vancouver; Jon Rescorla, Kelowna; Frederick Mundy; Klaus Leipert, both of Burnaby, all of Canada

[73] Assignee: Dreamco Enterprises Inc., West Vancouver, Canada

[21] Appl. No.: 813,569

[22] Filed: Mar. 10, 1997

[51] Int. Cl.[6] ..... G08B 15/02

[52] U.S. Cl. ..... 368/10; 340/574; 340/693; 368/243

[58] Field of Search ..... 368/201–205; 340/574, 693

[56] References Cited

U.S. PATENT DOCUMENTS

| | | | |
|---|---|---|---|
| 4,144,706 | 3/1979 | Willis . | |
| 4,287,510 | 9/1981 | Siegwarth . | |
| 4,379,639 | 4/1983 | Stephens . | |
| 4,587,516 | 5/1986 | Hiraki . | |
| 4,591,836 | 5/1986 | Feigenblatt, Jr. et al. . | |
| 4,694,284 | 9/1987 | Leveille et al. . | |
| 4,785,436 | 11/1988 | Sase | 368/205 |
| 4,806,911 | 2/1989 | Petri . | |
| 4,837,559 | 6/1989 | Green, Sr. . | |
| 5,005,002 | 4/1991 | Halperin . | |
| 5,006,832 | 4/1991 | Beaudry . | |
| 5,032,824 | 7/1991 | Corbin . | |
| 5,075,671 | 12/1991 | Livingston, III . | |
| 5,235,322 | 8/1993 | Obysovsky et al. . | |
| 5,260,915 | 11/1993 | Houlihan . | |
| 5,289,164 | 2/1994 | Novak . | |
| 5,296,839 | 3/1994 | Lu . | |
| 5,367,502 | 11/1994 | Barroso et al. . | |
| 5,420,570 | 5/1995 | Leitten et al. . | |

FOREIGN PATENT DOCUMENTS

| | | |
|---|---|---|
| 0038043A1 | 10/1981 | European Pat. Off. . |
| 08006567 | 1/1996 | Japan . |
| 2059126 | 4/1981 | United Kingdom . |
| 2268258 | 1/1994 | United Kingdom . |
| 2269494 | 2/1994 | United Kingdom . |

*Primary Examiner*—Bernard Roskoski
*Attorney, Agent, or Firm*—Oyen Wiggs Green & Mutala

[57] ABSTRACT

A personal security alarm in the form of a wearable case containing an sonic alarm transducer, a capacitor power supply, and a manually operable trigger for completing an electrical circuit between the power supply and the alarm transducer to operate the transducer by discharging the power supply. An oscillator is electrically connected between the power supply and the alarm transducer when the trigger operates, to output a variable frequency signal. An amplifier electrically connected between the oscillator and the alarm transducer amplifies the tone signal and drives the alarm transducer with the amplified signal. The oscillator can be programmed with a predefined variable frequency signal. A charger can be coupled through the case to charge the capacitor power supply without removing the power supply from the case. If the alarm is triggered, a catch mechanism must be released to deactivate the sonic alarm prior to completion of a preset interval, thus thwarting potential deactivation of the alarm, should an attacker seize control of it.

13 Claims, 9 Drawing Sheets

QUICK CHARGE CAPACITOR POWERED NON-INTERRUPTIBLE WEARABLE PERSONAL SECURITY ALARM

FIELD OF THE INVENTION

This application pertains to a personal security alarm which can be worn as a watch or other fashion accessory. The alarm is powered by capacitors which can be very quickly recharged. When triggered, the alarm emits a piercing high decibel sound.

BACKGROUND OF THE INVENTION

Personal security alarms which can be triggered in an emergency situation to emit alarm sounds are well known. Typically, they are carried as a separate accessory on a key chain, in a pocket, in a purse, etc. Because such modes of carrying can be inconvenient, users often forget to carry such alarms or carry them only sporadically, if at all. Moreover, reaching the alarm and activating it can be difficult and time consuming in an emergency situation if the user has to fumble in a pocket, purse, etc. to find the device, locate the alarm trigger and activate it. This may be virtually impossible in an emergency situation, particularly if the user is attempting to fend off an attacker. Even if the device is located and successfully activated it may be seized by the attacker and deactivated.

Some prior art personal security alarms can be worn on the wrist and are thus more readily accessible and less vulnerable to seizure or deactivation by an attacker. However, such devices are typically battery powered, which presents added inconvenience. Relatively bulky, expensive batteries must be periodically replaced, with the replacement frequency increasing dramatically if the alarm is triggered. A further disadvantage is that prior art devices are commonly easily deactivated. If such a device is seized by an attacker and deactivated, the objective of the device is thereby thwarted.

The present invention overcomes the foregoing disadvantages of the prior art.

SUMMARY OF THE INVENTION

In accordance with the preferred embodiment, the invention provides a personal security alarm, comprising a wearable case containing an sonic alarm transducer, a capacitor power supply, and a trigger for completing an electrical circuit between the power supply and the alarm transducer to operate the transducer by discharging the power supply capacitors. When the trigger is activated, an oscillator is electrically connected between the power supply and the alarm transducer. The oscillator outputs a variable frequency signal to the transducer. An amplifier electrically connected between the oscillator and the alarm transducer amplifies the signal and drives the alarm transducer with the amplified signal. The oscillator can be programmed with a predefined variable frequency signal.

A charger can be coupled through the case to charge the capacitor power supply without removing the power supply from the case.

DETAILED DESCRIPTION OF THE PREFERRED EMBODIMENT

Overview

Figure 1A:
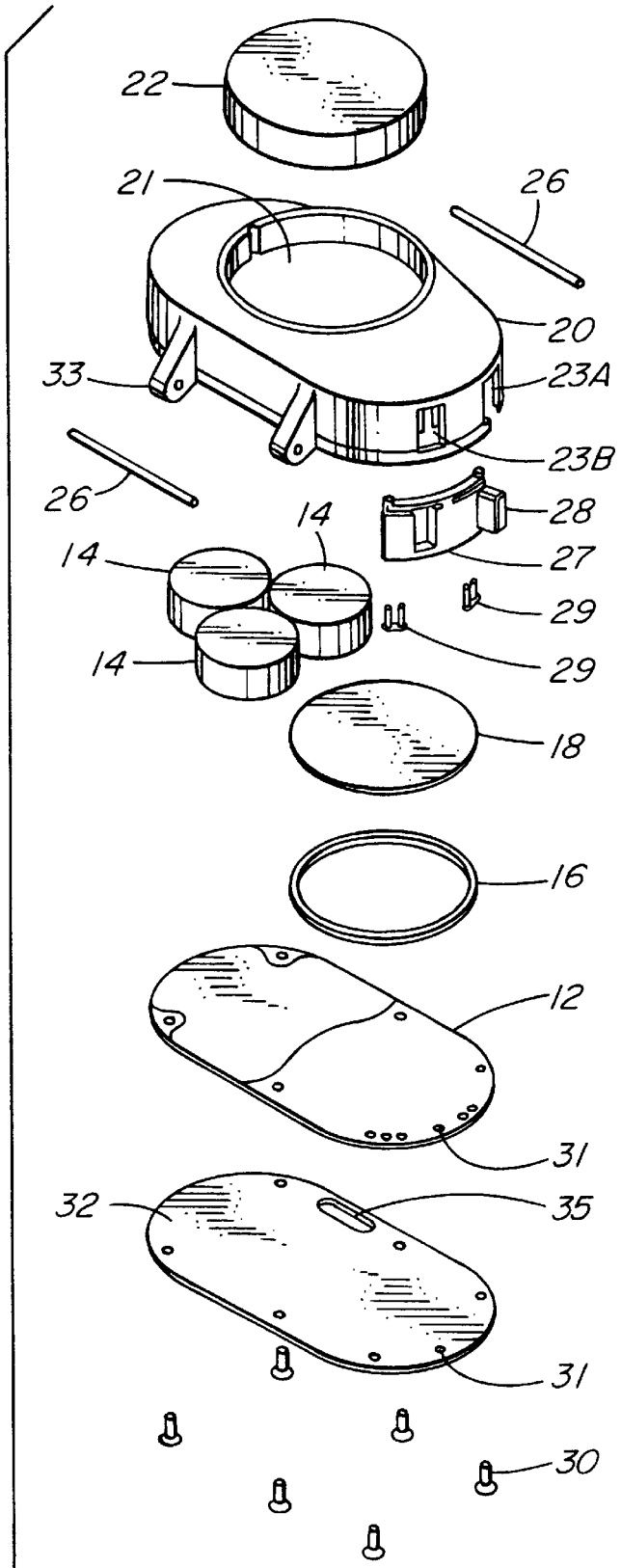
FIG. 1A is an exploded perspective illustration of a personal security alarm according to the preferred embodiment of the invention.
Figure 1B:
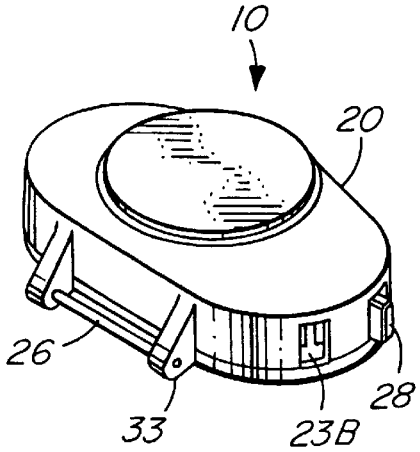
FIG. 1B is a top oblique perspective illustration of the assembled device.

As depicted in FIGS. 1A, 1B, 8A and 8B, the invention provides a personal security alarm 10 configured to be worn as a wristwatch. Electronic alarm circuit components are mounted on printed circuit board 12 as hereinafter explained. Three capacitors 14 serve as a power supply, as is also hereinafter explained in greater detail. Watch-like case 20 receives a conventional battery-powered digital watch mechanism 22 within cavity 21 to aid in disguising personal security alarm 10 as a common wristwatch. Spring-pins 26 are fitted into brackets 33, 34 provided on either side of case 20 to receive a watch strap (not shown) in conventional fashion.

Figure 9:
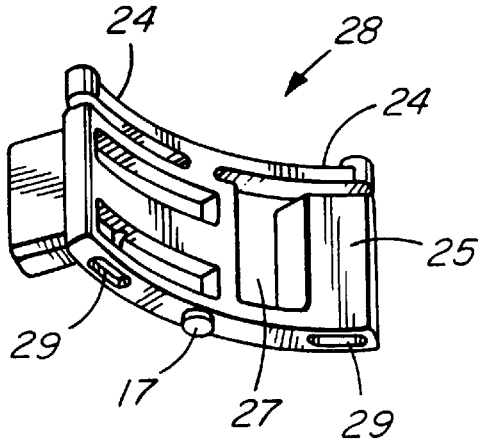
FIG. 9 is an enlarged bottom rear oblique perspective illustration of the slide switch component of the preferred embodiment.

Slide switch 28 (FIG. 9) is mounted in case 20, with the switch lever protruding through case aperture 23A. When the switch lever is moved into the alarm-triggering position shown in FIGS. 1B, 8A and 8B, slide switch aperture 27 is aligned with case aperture 23B, allowing alarm sounds to be emitted through the aligned apertures as hereinafter explained. A pair of metal contacts 29 (FIGS. 1A and 9) are fitted into the base of slide switch 28. When the switch lever is moved into the alarm-triggering position, contacts 29 complete an electrical circuit through printed circuit board 12 to trigger the alarm, as hereinafter explained in greater detail.

The upper portion of slide switch 28 is configured to form a pair of spring arms 24 which bear against the inner underside of case 20 and exert a downward biasing force on slide switch 28. As the switch lever is moved into the alarm-triggering position, projection 17 on the bottom of slide switch 28 slides across aperture 31 in backing plate 32 until projection 17 is aligned over aperture 31, at which point spring arms 24 force projection 17 downwardly into aperture 31. Once projection 17 is seated within aperture 31 as aforesaid slide switch 28 cannot easily be returned to the non-triggered position. Projection 17 thus serves as a catch mechanism to prevent deactivation of personal security alarm 10 once it has been triggered. In order to return slide switch 28 to the non-triggered position it is necessary to insert a thin probe (not shown) through aperture 31 to lift projection 17 upwardly out of aperture 31.

When the switch lever is not in the alarm-triggering position, case apertures 23A and 23B are covered by the non-apertured portions 25 (FIG. 9) of slide switch 28. Foreign matter is thus prevented from passing through case apertures 23A or 23B into case 20 when the switch lever is not in the alarm-triggering position.

Figure 1C:
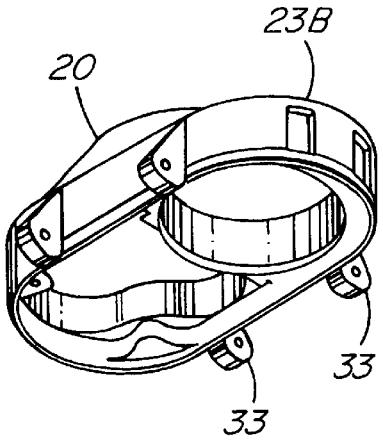
FIG. 1C is a bottom oblique perspective illustration of the case portion of the device with its backing plate removed.

A plurality of threaded fasteners 30 project through backing plate 32 and circuit board 12 into mating threaded apertures provided on the underside of case 20, to retain circuit board 12, capacitors 14, support ring 16 and piezoelectric alarm transducer 18 within appropriately shaped recesses in the underside of case 20, as seen in FIG. 1C. In particular, a tuned cavity 36 provided in the underside of case 20 receives alarm transducer 18. When personal security alarm 10 is triggered, alarm sounds emitted by transducer 18 are directed from cavity 36 through case apertures 23A, 23B with minimal attenuation loss.

Alarm Circuitry

Figure 2:
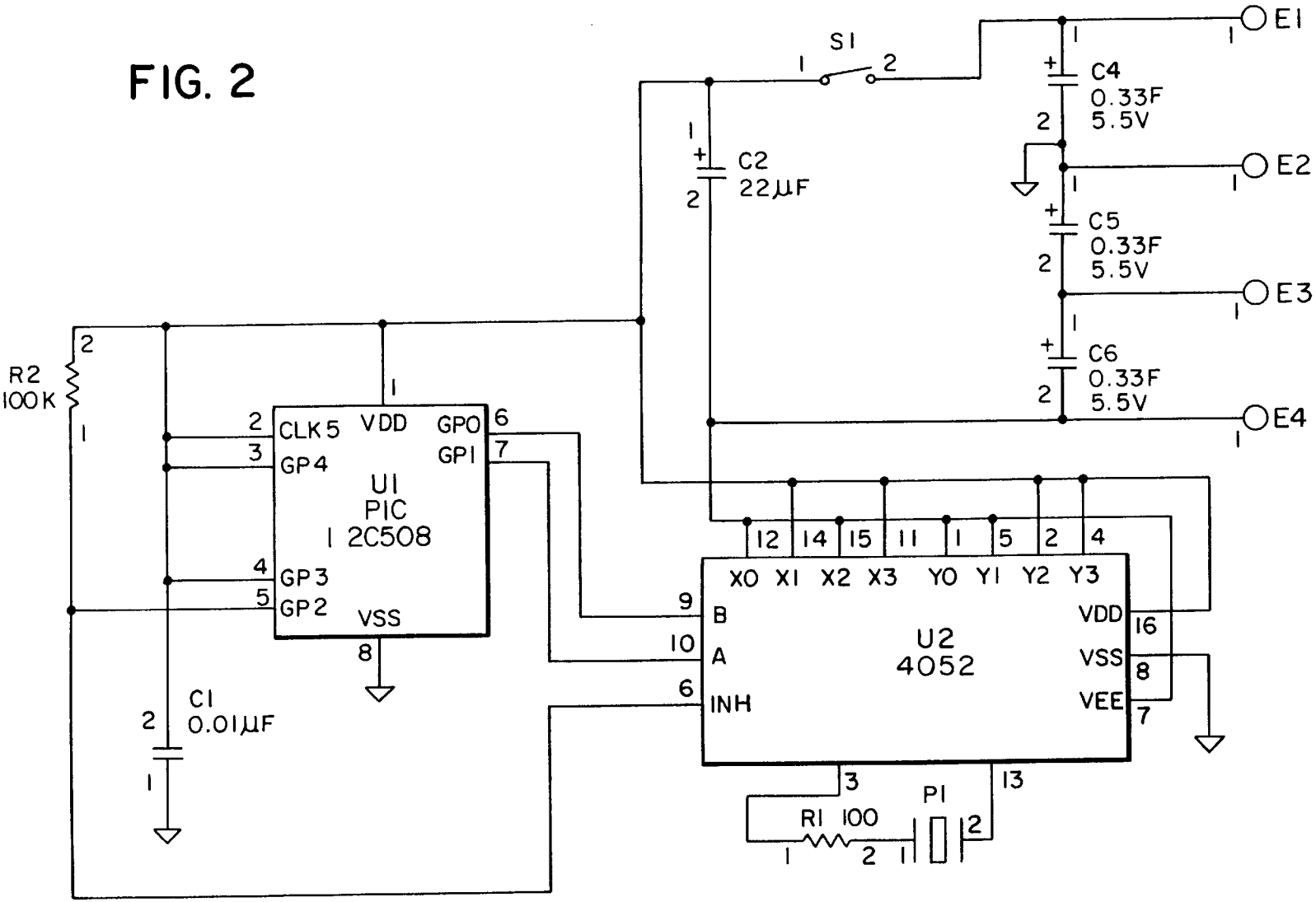
FIG. 2 is an electronic circuit schematic diagram of the alarm circuitry incorporated in the preferred embodiment.
Figure 3A:
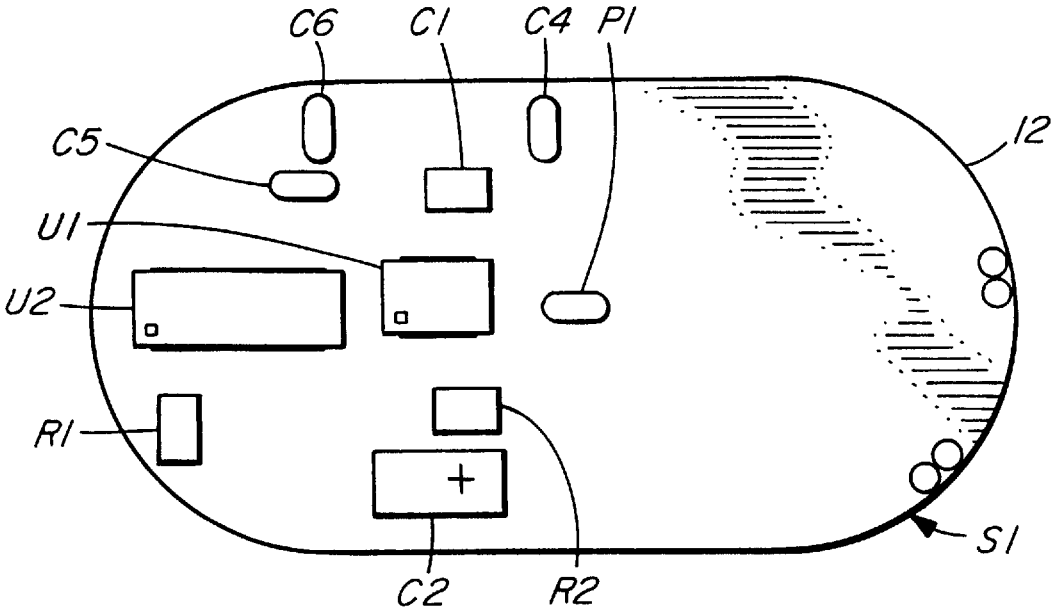
FIG. 3A illustrates the electronic component layout of a circuit board for mounting the FIG. 2 alarm circuitry within the FIG. 1B device.

Capacitors 14 are depicted in FIGS. 2 and 3 as components C4, C5 and C6. These high capacity, double layer capacitors are connected in series to generate both +5.5 volt and −11.0 volt power supply voltages. Slide switch 28 is depicted in FIGS. 2 and 3 as a normally open, single pole single throw switch S1.

Personal security alarm 10 is triggered as aforesaid by displacing slide switch 28 (i.e. closing switch S1) to apply a +5.5 volt power supply voltage to programmable microcontroller U1. Microcontroller U1 is pre-programmed as hereinafter explained to cause its internal oscillator to generate warbling alarm tone signals for output to analog multiplexer integrated circuit U2. Multiplexer U2 amplifies the alarm signals and outputs an amplified signal to drive piezoelectric alarm transducer 18 (represented in FIGS. 2 and 3A as P1). More particularly, the X0, X2, Y0, Y1 and VEE inputs of multiplexer U2 are electrically connected to the −11.0 volt power supply voltage; and its X1, X3, Y20, Y3 and VDD inputs are electrically connected to the +5.5 volt power supply voltage. Multiplexer U2 is thus able to apply the full 16.5 power supply volt range to piezoelectric alarm transducer 18 in either the positive or negative polarities. Piezoelectric alarm transducer 18 (P1) resonates at a sound pressure level of approximately 110 dB when discharged through case apertures 23A and 23B.

Personal security alarm 10 accordingly emits sustained, piercing, high intensity alarm sounds for the full preprogrammed interval described below. The necessity of releasing projection 17 from within aperture 31 before slide switch 28 can be returned to the non-triggered position deters unintended deactivation of personal security alarm 10, should an attacker seize control of personal security alarm 10 and attempt to deactivate it.

Charger

When fully charged, capacitors C4, C5 and C6 are capable of powering the alarm circuitry to drive piezoelectric alarm transducer 18 as aforesaid for about 90 seconds. Capacitors C4, C5 and C6 must be recharged at approximately 48 hour intervals, since their charge naturally dissipates over that interval, even without activation of the alarm. More frequent recharging is required if the alarm is activated, since such activation partially discharges capacitors C4, C5 and C6.

Figure 3B:
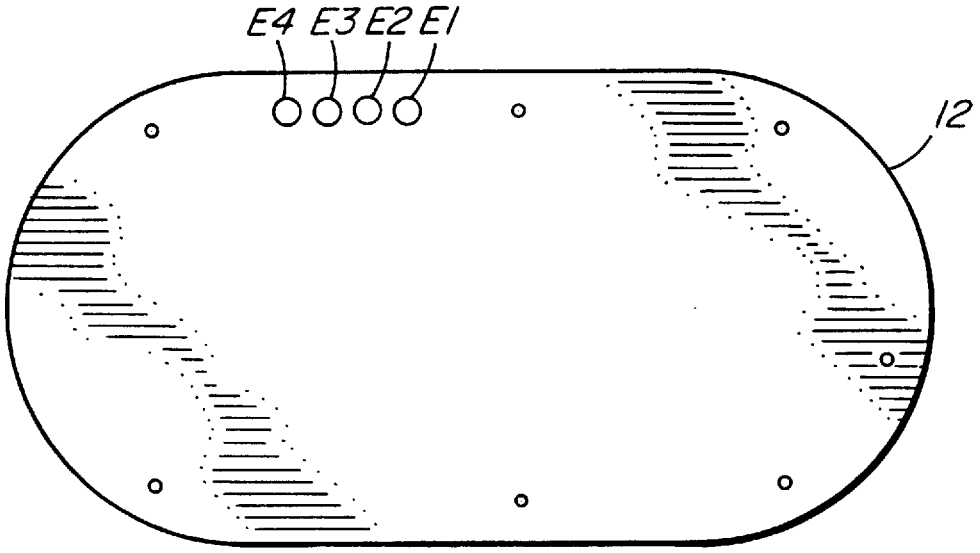
FIG. 3B shows the opposite side of the FIG. 3A circuit board.

Recharging is accomplished with the aid of four charging pads E1, E2, E3, E4 provided on circuit board 12, as shown in FIGS. 2, and 3B. Pads E1–E4 are aligned with aperture 35 in backing plate 32.

Figure 4:
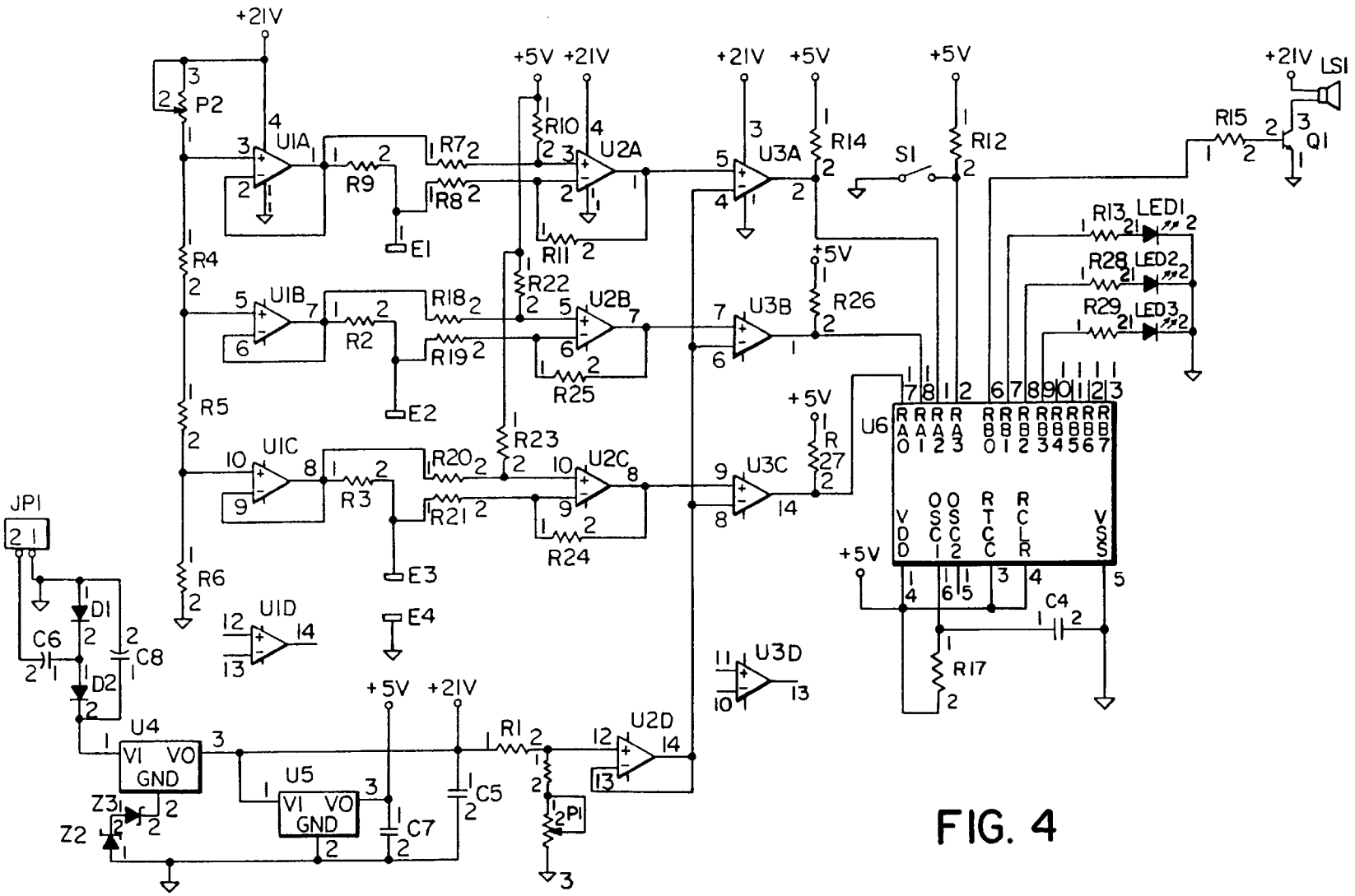
FIG. 4 is an electronic circuit schematic diagram of a charging circuit for recharging the capacitor power supply incorporated in the preferred personal security alarm.
Figure 6:
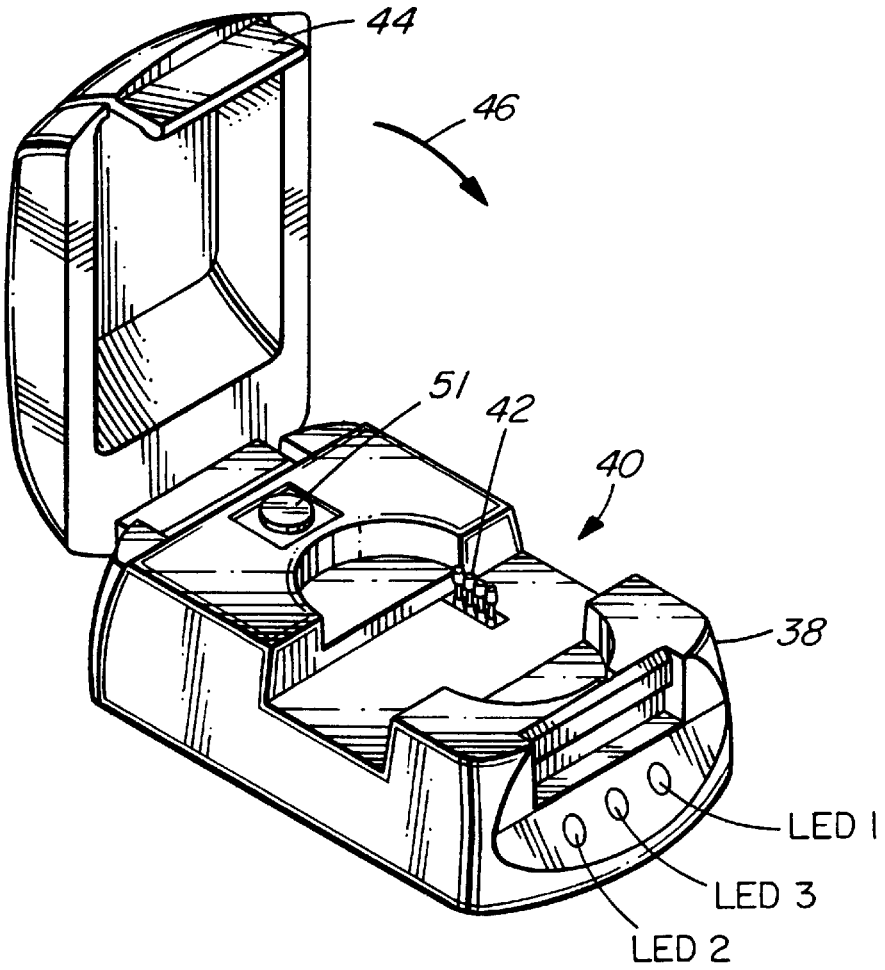
FIG. 6 is a perspective illustration of the preferred recharging device.

Capacitors C4, C5 and C6 are electrically connected to the FIG. 4 charging circuitry by positioning personal security alarm 10 in charger base 38 (FIG. 6). The user removes personal security alarm 10 from his/her wrist and lays personal security alarm 10 face up in channel 40 such that the ends of the watch strap (not shown) protrude through channel 40 to either side of charger base 38 and such that contacts 42 protrude through aperture 35 in backing plate 32 to contact pads E1–E4 on circuit board 12.

In FIG. 4, contacts 42 are separately identified as pads E1, E2, E3 and E4. It will be understood that these pads are brought into physical contact with pads E1–E4 provided in personal security alarm 10 by placing alarm 10 in charger base 38 as aforesaid. For ease of reference, the FIG. 4 charging circuitry is collectively called the "charger".

When power is first applied to the charger, light emitting diodes LED1, LED2, LED3 and an audible signalling device such as tone beeper LS1 turn on momentarily to indicate proper operation of the charger. Thereafter, only green "ready" light emitting diode LED2 remains on until personal security alarm 10 is inserted into the charger and cover 44 (FIG. 6) pivoted downwardly in the direction of arrow 46 to close switch S1, which remains closed until personal security alarm 10 is removed from the charger. As the charging operation proceeds, "ready" LED2 turns off and orange "charging in progress" LED1 turns on. If the charging operation is completed within 30 seconds (as is typical), "charging in progress" LED1 turns off, beeper LS1 emits three short beeps and "ready" LED2 turns on. If the charging operation is not completed within 30 seconds, red "alarm" light emitting diode LED3 turns on indicating a possible problem with personal security alarm 10. Charging continues as long as personal security alarm 10 remains inserted within the charger, even after "alarm" LED3 turns on. Upon completion of the charging operation cover 44 is raised, personal security alarm 10 removed from charger base 38 and may then be reused for up to another 48 hours before capacitors C4, C5 and C6 again require recharging.

Power input is derived from a conventional 12 VAC output AC wall adaptor transformer connected at JP1. Diode D1 serves as a half wave rectifier to charge capacitor C6 toward the +12 volt level (capacitor C6 may be charged in excess of +12 volts to approximately +18 volts, depending on the voltage input provided by transformer JP1). The (nominal) +12 volt charge accumulated on capacitor C6 is applied to voltage doubler diode D2 and to tone beeper LS1. Diode D2 charges filter capacitor C8 to approximately +35 volts, which is reduced by approximately 8 volts by zener diode Z1 and then applied to voltage regulators U4 and U5. US is a 5 volt linear voltage regulator integrated circuit which produces the +5 volt supply voltage required by microcontroller integrated circuit U6. U4 is also a 5 volt regulator integrated circuit which, in combination with zener diodes Z2 and Z3, forms a voltage regulator circuit to produce a nominal +21 volt supply voltage required by integrated circuit amplifiers U1, U2 and voltage comparator U3. Operational amplifier U2D, in combination with voltage divider resistors R1, R16 and P1 provides a variable reference voltage which is applied to the reference voltage inputs of voltage comparators U3A, U3B and U3C.

High current output operational amplifiers U1A, U1B and U1C are each configured for unity gain operation, with their output ports connected back to their respective negative input ports. The voltage signals output by the voltage divider formed by resistors P2, R4, R5 and R6 (P2 effectively sets the charge voltage) are applied to the positive input ports of operational amplifiers U1A, U1B and U1C. The operational amplifiers' outputs thus exactly reflect the voltages present at the junctions of P2, R4, R5 and R6 and provide a constant voltage source for power supply capacitors C4, C5 and C6 located inside personal security alarm 10. Resistors R9, R2 and R3 respectively limit the charging current and also provide current sense voltage for the inputs to differential amplifiers U2A, U2B and U2C. The output ports of differential amplifiers U2A, U2B and U2C are applied to the positive input ports of voltage comparators U3A, U3B and U3C respectively. The reference voltage input to each of comparators U3A, U3B and U3C is determined by potentiometer P1, to fix the threshold current at which capacitors C4, C5 and C6 are considered fully charged. Comparators U3A, U3B and U3C are configured with open collector outputs connected to the +5 supply voltage via resistors R14, R26 and R27, effectively providing a 0/5 volt level shift suitable for connecting to the input ports of microcontroller U6.

Microcontroller U6 controls the operation of LED1, LED2, LED3 and tone beeper LS1. In the idle powered up state (i.e. before insertion of personal security alarm 10), green "ready" LED2 is on and orange "charging in progress" LED1 and red "alarm" LED3 are off. As soon as S1 is operated (by insertion of personal security alarm 10 as aforesaid), U6 starts a 30 second timer and continuously monitors comparators U3A, U3B and U3C to determine whether any of capacitors C4, C5 or C6 are charging at a current above the preset threshold current.

If any of capacitors C4, C5 or C6 are found to be charging above the threshold current, completion of the charging operation is indicated by turning green "ready" LED2 off, flashing orange "charge in progress" LED1 at a rate of about one hertz, and beeping tone beeper LS1 at the same rate. Such operation continues until the first to occur of either the following events: (1) capacitors C4, C5 and C6 are sufficiently charged that all charge currents are below the preset current threshold (i.e. until the outputs of U3A, U3B and U3C are all at the logic low state); or, (2) the aforementioned 30 second timer expires. If event (1) occurs first microcontroller UG turns off orange "charging in progress" LED1, turns on green "ready" LED2 and causes tone beeper LS1 to emit a series of three short beeps. If event (2) occurs first (i.e. if the 30 second timer expires while any of capacitors C4, C5 or C6 is still charging above the threshold charge current), microcontroller U6 turns off orange "charging in progress" LED1, silences tone beeper LS1 and turns on red "alarm" LED3 until cover 44 is released and personal security alarm 10 is removed from the charger.

Software Description

Figure 5A:
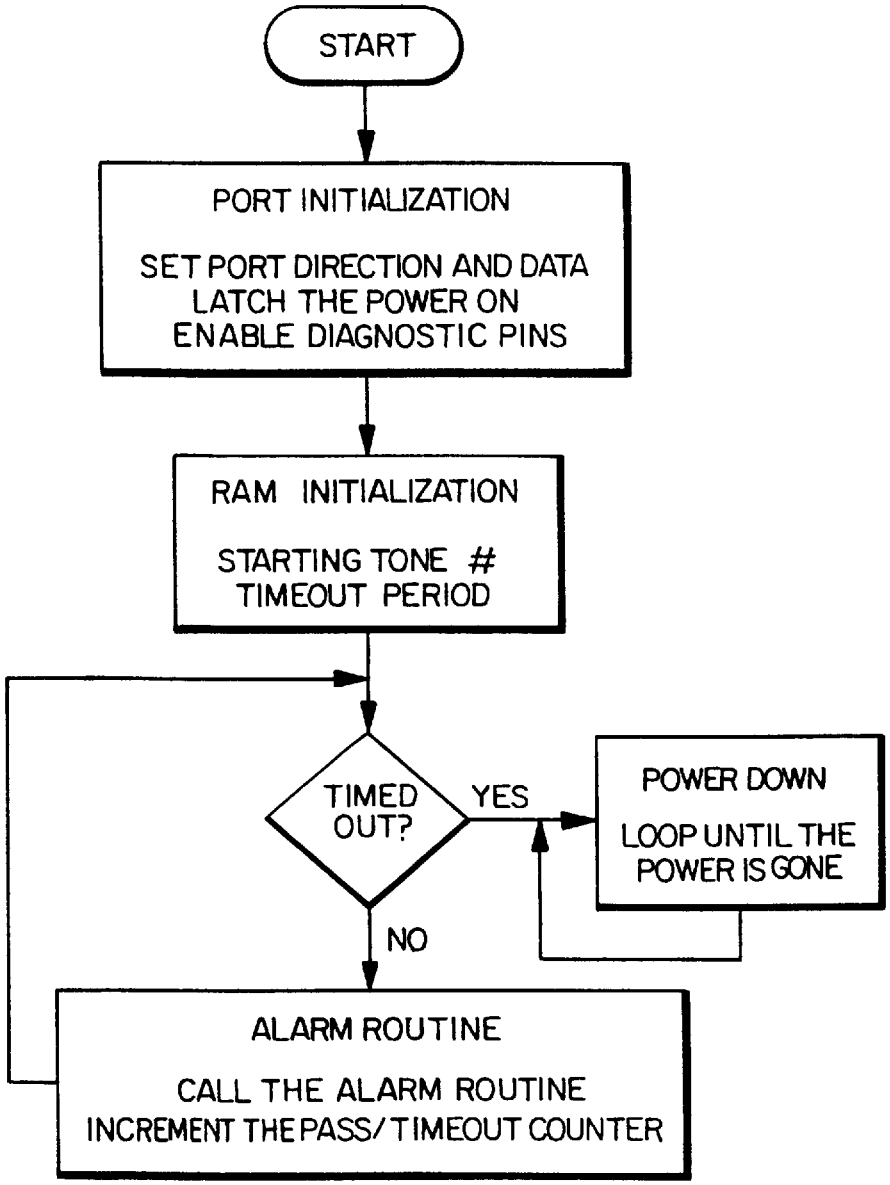
FIGS. 5A and 5B are flowcharts which illustrate the sequence of steps performed by computer software which controls the operation of the microprocessor incorporated in the preferred personal security alarm.
Figure 5B:
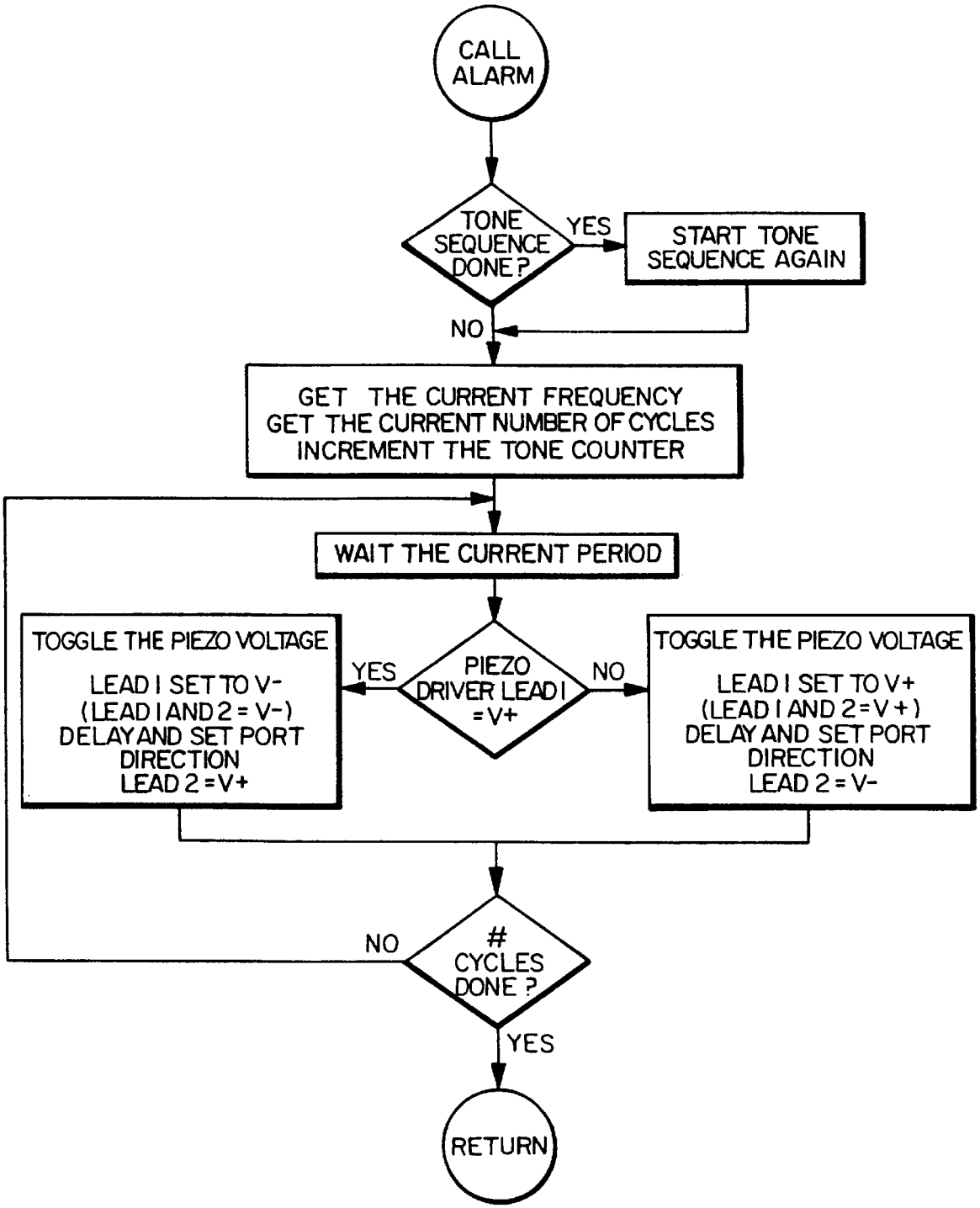

FIGS. 5A and 5B are flowcharts which illustrate the sequence of steps performed by computer software which controls the operation of programmable microcontroller integrated circuit U1 (FIG. 2) incorporated in personal security alarm 10.

When power is initially applied to microcontroller U1, its output ports are initialized and power supply latch pin VDD is activated. This allows momentary switch contact S1 to activate the alarm for its full preprogrammed duration when slide switch 28 is moved into the alarm triggering position as aforesaid.

The microcontroller's on-chip random access memory (RAM) is also initialized. The software then calls the Alarm Routine (FIG. 5B). After about 90 seconds, the software enters a tight loop to prevent unpredictable processor activity, should the available power derived from capacitors C4, C5 and C6 drop below a minimum threshold.

The Alarm Routine (FIG. 5B) generates a sequence of predetermined frequencies and periods which repeat for a preprogrammed interval. The alarm tone is defined by a period value and a value representative of the number of cycles. These values are fetched from look up tables. The program waits one half period, toggles alarm transducer 18's output voltage, then checks to see if the required number of cycles have been completed. If more cycles are required the process repeats.

Alarm transducer 18 is driven differentially to increase its audible output while preventing excessive loading of the microcontroller's outputs. Instead of inverting the voltages applied to transducer 18 via its two input leads, the leads are sequentially switched in a four step pattern:

| | | |
|---|---|---|
| 1. | lead 1 V+, lead 2 V− | stable for one half period of the current frequency |
| 2. | lead 1 V−, lead 2 V− | pause and reset output port direction |
| 3. | lead 1 V−, lead 2 V+ | stable for one half period of the current frequency |
| 4. | lead 1 V+, lead 2 V+ | pause and reset output port direction |

Figure 7:
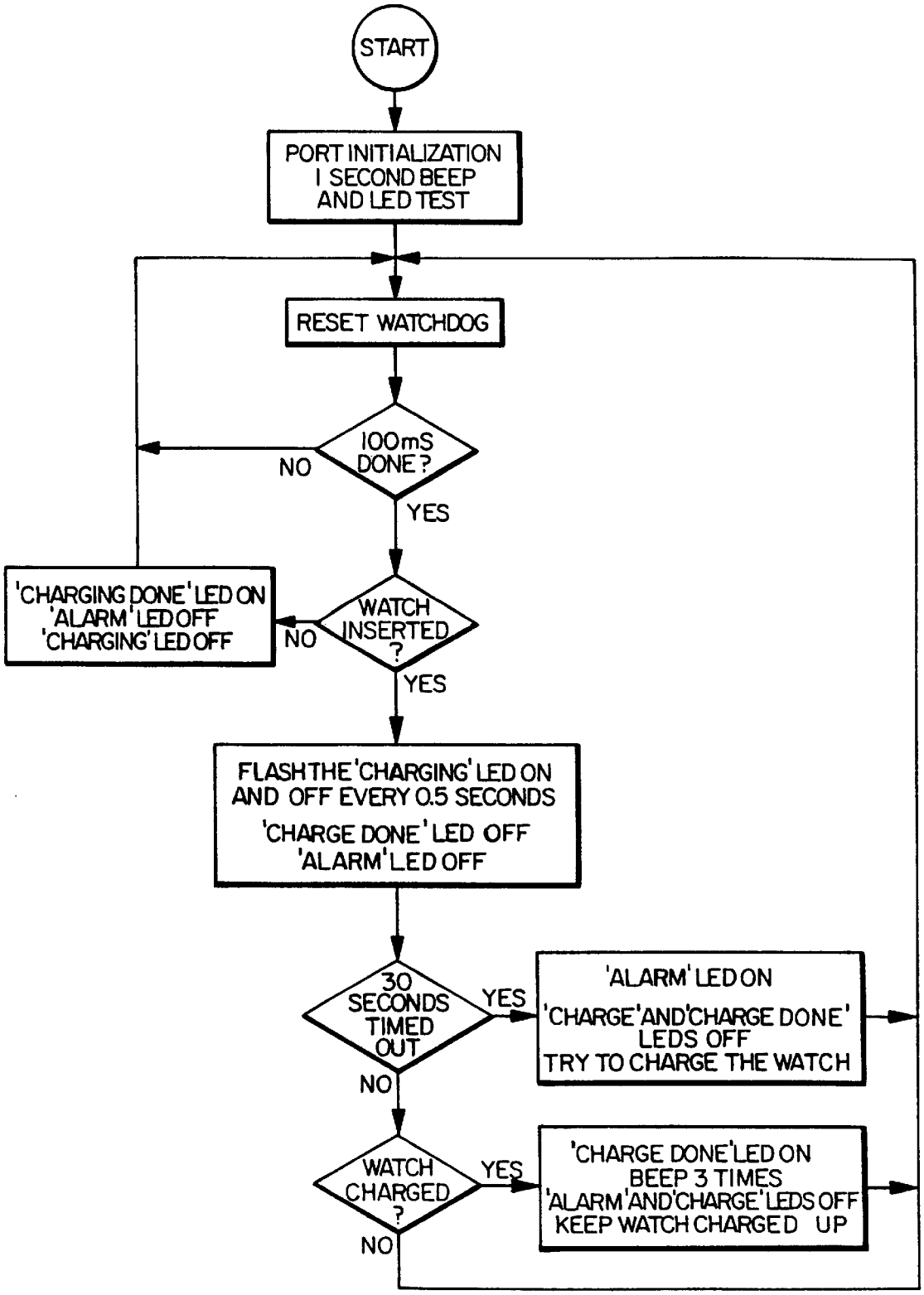
FIG. 7 is a flowchart which illustrates the sequence of steps performed by computer software which controls the operation of the microprocessor incorporated in the preferred recharging device.
Figure 8A:
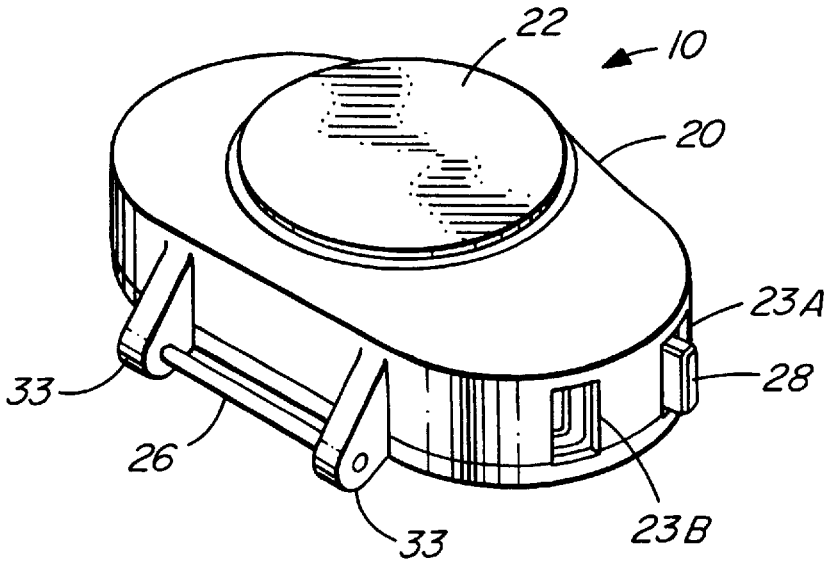
FIGS. 8A and 8B are respectively enlarged top and bottom oblique perspective illustrations of the FIG. 1B device of FIG. 1B, showing the alarm activation switch in its alarm-triggering position.
Figure 8B:
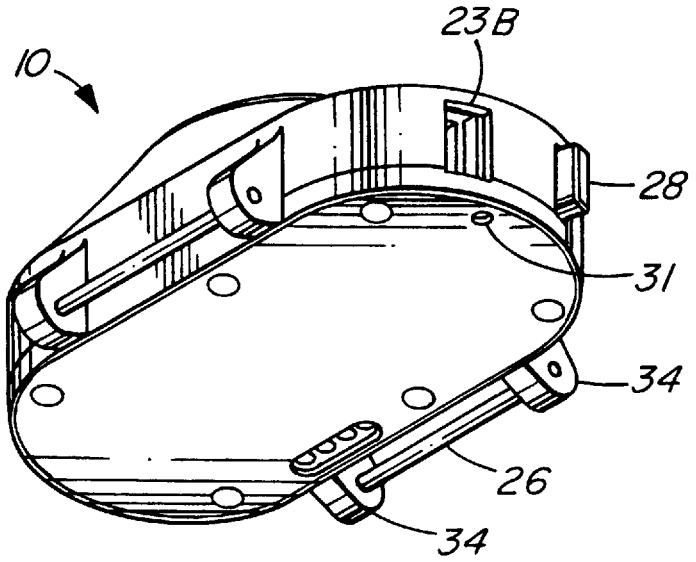

The FIG. 7 flowchart illustrates the sequence of steps performed by computer software which controls the operation of microcontroller integrated circuit U6 incorporated in the recharger. When power is initially applied to the microcontroller U1 its output ports and internal variables are initialized. The main loop is repeated approximately every 0.1 seconds. Each iteration of the main loop ends with a check to determine whether a watch (i.e. personal security alarm 10) has been inserted for charging. If not, green "ready" LED2 is turned on, orange "charging in progress" LED1 and red "alarm" LED3 are turned off, and the main loop repeats. If alarm 10 is inserted in charger base 38 and cover 44 closed, LED2 is turned off and LED1 is intermittently flashed on and off. Charging proceeds as described above, until one of two conditions occur:

a) If charging requires more than 30 seconds LED3 is turned on. Charging continues as long as alarm 10 remains in charger base 38.

b) Charging is completed within 30 seconds. In this case, LED1 stops flashing and turns off, LED2 turns on and beeper LS1 emits three beeps.

After charging is complete (or after charging has progressed for 30 seconds) program control returns to the main loop where a check is made at 0.1 second intervals to see determine whether alarm 10 has been removed from charger base 38, at which time LED2 is again turned on, LED1 and LED3 are turned off, and the main loop again cycles at 0.1 second intervals to determine whether alarm 10 has been inserted in charger base 38.

Electronic Components Parts Lists

Alarm Circuitry

| | |
|---|---|
| C1 | 0.01 μf capacitor |
| C4, C5, C6 | .33 f double layer high capacity capacitor |
| C2 | 22 μf capacitor |
| R1 | 100 Ω load resistor |
| R2 | 100K Ω resistor |

-continued

| Electronic Components Parts Lists | |
|---|---|
| P1 | Project Unlimited KBI-2038 piezoelectric transducer |
| S1 | normally open SPST switch |
| U1 | P.I.C. 12C508 programmable microcontroller |
| U2 | CD4052 analog multiplexer |
| Charger | |
| C4 | 270 pf capacitor |
| C5, C7 | .1 μf capacitor |
| C6 | 470 μf, 24 volt capacitor |
| C8 | 470 μf, 43 volt capacitor |
| D1, D2 | 1N4000 diode |
| E1–E4 | spring contacts |
| JP1 | power supply jack |
| LED1 | orange light emitting diode |
| LED2 | green light emitting diode |
| LED3 | red light emitting diode |
| LS1 | tone beeper |
| R1 | 270 KΩ resistor |
| R2, R3, R9 | 100 Ω resistor |
| R10, R11, R22–R25 | 150 Ω resistor |
| R13, R28, R29 | 330 Ω resistor |
| P1, R12, R14, R17, R26, R27 | 100 KΩ resistor |
| R15 | 4.7 KΩ resistor |
| R16 | 110 KΩ resistor |
| P2, R4–R8, R18–R21 | 10 KΩ resistor |
| Q1 | 2N3904 transistor |
| S1 | normally open SPST switch |
| U1 | MC33179 operational amplifier |
| U2 | LM324 differential amplifier |
| U3 | LM339 voltage comparator |
| U4, U5 | LM78M05 voltage regulator |
| U6 | PIC16C54RC microcontroller |
| Z1 | 1N4738A zener diode |
| Z2, Z3 | 1N5232B zener diode |

It can thus be seen that the invention provides a personal security alarm which can be disguised to look and operate as a fashion accessory such as a wristwatch. This increases the likelihood that users will habitually wear the personal security alarm. If the personal security alarm is worn, instead of carried separately, it remains readily accessible for rapid activation in an emergency situation and is less likely to be seized by an attacker. Fashion accessories such as wristwatches are universally accepted by both sexes, young and old alike, so the invention is readily adaptable for use by anyone in need of a personal security alarm.

As will be apparent to those skilled in the art in the light of the foregoing disclosure, many alterations and modifications are possible in the practice of this invention without departing from the spirit or scope thereof. For example, instead of being configured as a watch, personal security alarm 10 may be configured as a brooch, belt buckle, or other easily accessible, wearable jewellery or personal accessory item. Accordingly, the scope of the invention is to be construed in accordance with the substance defined by the following claims.

What is claimed is:

1. A personal security alarm, comprising a wearable case containing:

(a) an sonic alarm transducer for producing a personal security alarm sound;

(b) a high capacity, double layer capacitor power supply;

(c) a manually operable trigger movable between an alarm-triggering position and a non-alarm-triggering position for completing an electrical circuit between said capacitor power supply and said alarm transducer to operate said transducer to produce said alarm sound by discharging said capacitor power supply;

(d) an oscillator electrically connectible between said capacitor power supply and said alarm transducer by operation of said trigger, for output by said oscillator of a variable frequency signal;

(e) an amplifier electrically connected between said oscillator and said alarm transducer to amplify said tone signal and apply said amplified signal to drive said alarm transducer; and, (f) a tuned cavity surrounding said alarm transducer, said cavity for low attenuation emission of said alarm sound through an aperture in said case, said aperture being closed when said trigger is in said non-alarm-triggering position and open when said trigger is in said alarm-triggering position.

2. A personal security alarm as defined in claim 1, wherein said oscillator is programmable to predefine said variable frequency signal.

3. A personal security alarm as defined in claim 1, further comprising a charger couplable through said case to charge said capacitor power supply without removal of said capacitor power supply from said case.

4. A personal security alarm as defined in claim 1, wherein said capacitor power supply comprises a capacitance of at least 0.33 farads.

5. A personal security alarm as defined in claim 1, wherein said capacitor power supply comprises a capacitance of about one farad.

6. A personal security alarm as defined in claim 1, wherein said case further contains a watch.

7. A personal security alarm as defined in claim 1, further comprising a catch mechanism for maintaining said switch in said alarm-triggering position after initial displacement of said switch into said alarm-triggering position.

8. A personal security alarm as defined in claim 3, wherein said charger further comprises a constant voltage amplifier for applying a charging voltage to said capacitor power supply.

9. A personal security alarm as defined in claim 8, wherein said charger further comprises a voltage comparator electrically connected to compare signals respectively representative of:

(i) current flow through said constant voltage amplifier; and, (ii) a reference current representative of a fully charged condition of said capacitor power supply.

10. A personal security alarm as defined in claim 9, wherein said charger further comprises a differential amplifier electrically connected between said constant voltage amplifier and said voltage comparator to produce said signal representative of current flow through said constant voltage amplifier.

11. A personal security alarm as defined in claim 10, wherein said charger further comprises a microcontroller electrically connected to said voltage comparator to programmably control operation of means for indicating current operational status of said charger.

12. A personal security alarm as defined in claim 10, wherein said means for indicating current operational status of said charger comprises:

(a) a "ready" light for indicating attainment of said fully charged condition by said capacitor power supply;

(b) a "charging in progress" light for indicating charging of said capacitor power supply; and, (c) an "alarm" light for indicating failure of said capacitor power supply to attain said fully charged condition within a predetermined time interval.

13. A personal security alarm as defined in claim 12, wherein said means for indicating current operational status of said charger further comprises an audible signalling device.

* * * * *